US010683598B2

(12) United States Patent
Yonezawa et al.

(10) Patent No.: US 10,683,598 B2
(45) Date of Patent: Jun. 16, 2020

(54) WASHING MACHINE

(71) Applicants: QINGDAO HAIER WASHING MACHINE CO., LTD., Qingdao, Shandong (CN); AQUA CO., LTD., Tokyo (JP)

(72) Inventors: Takaaki Yonezawa, Tokyo (JP); Tomonari Kawaguchi, Tokyo (JP); Hiroki Sato, Tokyo (JP); Yoshikazu Bamba, Tokyo (JP); Takashi Onishi, Tokyo (JP); Wataru Nakagawa, Tokyo (JP)

(73) Assignees: QINGDAO HAIER WASHING MACHINE CO., LTD., Qingdao, Shandong (CN); AQUA CO., LTD, Chiyoda-ku, Tokyo (JP)

( * ) Notice: Subject to any disclaimer, the term of this patent is extended or adjusted under 35 U.S.C. 154(b) by 0 days.

(21) Appl. No.: 15/774,265

(22) PCT Filed: Feb. 28, 2017

(86) PCT No.: PCT/CN2017/075184
§ 371 (c)(1),
(2) Date: May 7, 2018

(87) PCT Pub. No.: WO2017/148367
PCT Pub. Date: Sep. 8, 2017

(65) Prior Publication Data

US 2018/0363207 A1 Dec. 20, 2018

(30) Foreign Application Priority Data

Feb. 29, 2016 (JP) ..... 2016-038469

(51) Int. Cl.
*D06F 37/28* (2006.01)
*D06F 23/04* (2006.01)
(Continued)

(52) U.S. Cl.
CPC ..... *D06F 37/28* (2013.01); *D06F 23/04* (2013.01); *D06F 39/088* (2013.01); *D06F 39/14* (2013.01)

(58) Field of Classification Search
None
See application file for complete search history.

(56) References Cited

U.S. PATENT DOCUMENTS 3,269,544 A * 8/1966 Brucken ..... D06F 37/24 210/364
2006/0260543 A1 11/2006 Hiruma et al.
(Continued)

FOREIGN PATENT DOCUMENTS

CA 2539090 10/2006
CN 2612690 4/2004
(Continued)

OTHER PUBLICATIONS

International Application No. PCT/CN2017/075184, International Search Report, dated Jun. 2, 2017.

*Primary Examiner* — Cristi J Tate-Sims
(74) *Attorney, Agent, or Firm* — Greenberg Traurig

(57) ABSTRACT

A washing machine, which does not have a narrowed portion on a throw-in and takeout route of washings, so that washings can be thrown in and taken out smoothly. The washing machine of the present invention comprises: an inner tub for accommodating washings; an outer tub for accommodating the inner tub; a housing comprising a housing body that is configured to accommodate the outer tub and is open at the upper end, a fixed lid fixed to the upper end of the housing body, and a movable lid that is movably disposed on the fixed lid, makes the upper end of the housing body selectively open towards the outside, and is capable of forming a lid side opening for making an inner tub side opening formed on the upper end of the inner tub open upwards; and
(Continued)

a water supply unit provided on the fixed lid and used for supplying water to the inner tub, wherein the inner circumference of the lid side opening has a shape and size that make the inner tub side opening substantially open upwards.

6 Claims, 6 Drawing Sheets

(51) Int. Cl.
*D06F 39/08* (2006.01)
*D06F 39/14* (2006.01)

(56) References Cited

U.S. PATENT DOCUMENTS

| | | | | |
|---|---|---|---|---|
| 2013/0185873 | A1* | 7/2013 | Bomar | D06F 39/008 8/137 |
| 2015/0128657 | A1* | 5/2015 | Kim | D06F 39/083 68/132 |
| 2015/0345071 | A1* | 12/2015 | Lee | D06F 29/00 68/27 |
| 2018/0038040 | A1* | 2/2018 | Kim | D06F 39/14 |

FOREIGN PATENT DOCUMENTS

| | | | |
|---|---|---|---|
| CN | 102304837 | A | 1/2012 |
| CN | 103710943 | | 4/2014 |
| CN | 105274766 | | 1/2016 |
| JP | H05168794 | A | 7/1993 |
| JP | 3125784 | B2 | 1/2001 |
| JP | 2005253626 | | 9/2005 |

* cited by examiner

WASHING MACHINE

The present application is a national phase application under 35 U.S.C. § 371 of International Patent Application PCT/CN2017/075184, filed on Feb. 28, 2017, which claims priority to Japanese Patent Application No. 2016-038469, filed on Feb. 29, 2016, the entire disclosures of which applications are hereby incorporated herein by reference.

TECHNICAL FIELD

The present disclosure mainly relates to a washing machine suitable for household use.

BACKGROUND

In the past, a top-loading washing machine is formed in such a manner that a cylindrical tub and a drum are arranged in a housing with a rectangular shape when observed from top. The housing is provided with a fixed lid as an upper surface plate fixed to an upper surface of the housing and a movable lid as an upper cover movably arranged relative to the fixed lid. A water supply part is arranged on the fixed lid. The movable lid as the upper cover is opened and closed to open an opening of the drum.

In this way, under a condition that the housing has a rectangular shape when observed from top relative to the tub, the water supply part should be provided on the upper surface of the fixed lid as the upper surface plate of the housing in order to place the housing closely to a wall surface of an residence as a place where the housing is carried. Therefore, since a part regarded as the upper surface plate is increased, even if the movable lid as the upper cover is opened, an opening of a circular drum cannot be integrally opened relative to a rectangular opening. Thus, part of a throwing-in and taking-out route of laundry is narrowed, which is inconvenient for the operations of throwing-in and taking-out. Moreover, when the washing machine is observed from top, a whole internal part of the cylindrical drum cannot be seen and a dead angle zone in which a washing condition cannot be seen exists.

EXISTING TECHNICAL LITERATURE

Patent Literature

Patent Literature 1: Japan specifically disclosed No. 2005-253626 Bulletin

SUMMARY

Problems to be Solved by the Disclosure

The present disclosure aims to effectively solve such problems. A purpose of the present disclosure is to provide a washing machine formed in such a manner that part of a throwing-in and taking-out route of laundry is narrowed, and operations of throwing-in and taking-out may be performed smoothly.

Solution for Solving the Problems

In view of the above problems, the present disclosure adopts the following solution.

That is, the washing machine of the present disclosure includes: a drum for accommodating laundry and formed with a drum side opening; a tub for accommodating the drum; and a housing for accommodating the drum and the tub, wherein the housing includes: a cylindrical body with an upper end being open; a bottom wall arranged on a lower end of the cylindrical body and configured to support the tub from a lower side; a fixed lid fixed to the upper end of the cylindrical body and formed with a lid side opening; and a movable lid arranged on the fixed lid and is configured to block the lid side opening; the washing machine has a water supply part arranged on a side wall of the housing or the fixed lid and configured to supply water to the drum; and an inner circumference of the lid side opening has a shape obtained by opening the drum side opening approximately upwards integrally.

In addition, in the present disclosure, an opening edge of the lid side opening is disposed at an outer side of any position of an opening edge of the drum side opening.

In addition, in the present disclosure, a profile of the housing, the tub and the drum are formed as a concentric circle shape, and the movable lid is configured as a disk shape.

In addition, in the present disclosure, the housing has a hinging part for movably supporting the movable lid relative to the fixed lid, and the water supply part is disposed at a position for displacing from the hinging part along a circumferential direction.

In addition, in the present disclosure, the washing machine further includes a water receiving guidance component arranged between the lid side opening and the drum side opening and configured to guide throwing-in and taking-out of laundry from the lid side opening to the drum side opening; and the water receiving guidance component has an approximately conical shape. The conical shape has an upper end with an opening larger than the drum side opening and a lower end with a size approximately matching with the drum side opening.

Effects of the Disclosure

According to the present disclosure described above, by providing an inner circumference of the lid side opening as a shape of opening the drum side opening approximately upwards integrally, the fixed lid as the upper surface plate is contracted and the movable lid performing a function as the upper cover is increased, so that the washing machine is formed in such a manner that part of a throwing-in and taking-out route of laundry is not narrowed, and operations of throwing-in and taking-out may be performed smoothly. In addition, according to the present disclosure, the water supply part is arranged at a non-blocking position, thereby avoiding a structure of supplying water from the upper surface of the upper cover as the upper surface plate. As a result, when the washing machine is observed from top, since the cylindrical drum is integrally in a visual state, it is easy to see a washing condition.

In addition, according to the present disclosure, since the opening edge of the lid side opening is disposed at the outer side of any position of the opening edge of the drum side opening, the whole drum can be upwards opened reliably.

In addition, according to the present disclosure, the profile of the housing, the tub and the drum are formed as a concentric shape, and the movable lid is configured as a disk shape. Thus, as long as the fixed lid as the upper surface plate is circular annular or the side wall of the housing is cylindrical, a distance to the drum may not be changed regardless of the position of arranging the water supply part in the circumferential direction, thereby effectively enhancing the freedom of placing the water supply part.

In addition, according to the present disclosure, the water supply part is arranged in the position of displacing from the hinging part to the circumferential direction, so that a hinge is arranged along a wall. The water supply part is equivalent to be arranged at a position of a corner part of an existing rectangular housing, so that no hindrance exists even if a same configuration as before is adopted.

In addition, according to the present disclosure, since the water receiving guidance component arranged between the lid side opening and the drum side opening and is configured to guide throwing-in and taking-out of the laundry from the lid side opening to the drum side opening is provided as the approximately conical shape and the approximately conical shape has an upper end with an opening larger than the drum side opening and a lower end with a size approximately matching with the drum side opening, even if the water supply part is arranged in the above position, water can be injected and operations of throwing-in or taking-out of the laundry can be performed more smoothly. Moreover, the visibility of the drum may not be deteriorated when the washing machine is observed from top.

DETAILED DESCRIPTION

An embodiment of the present disclosure is specifically described below according to drawings.

Figure 1:
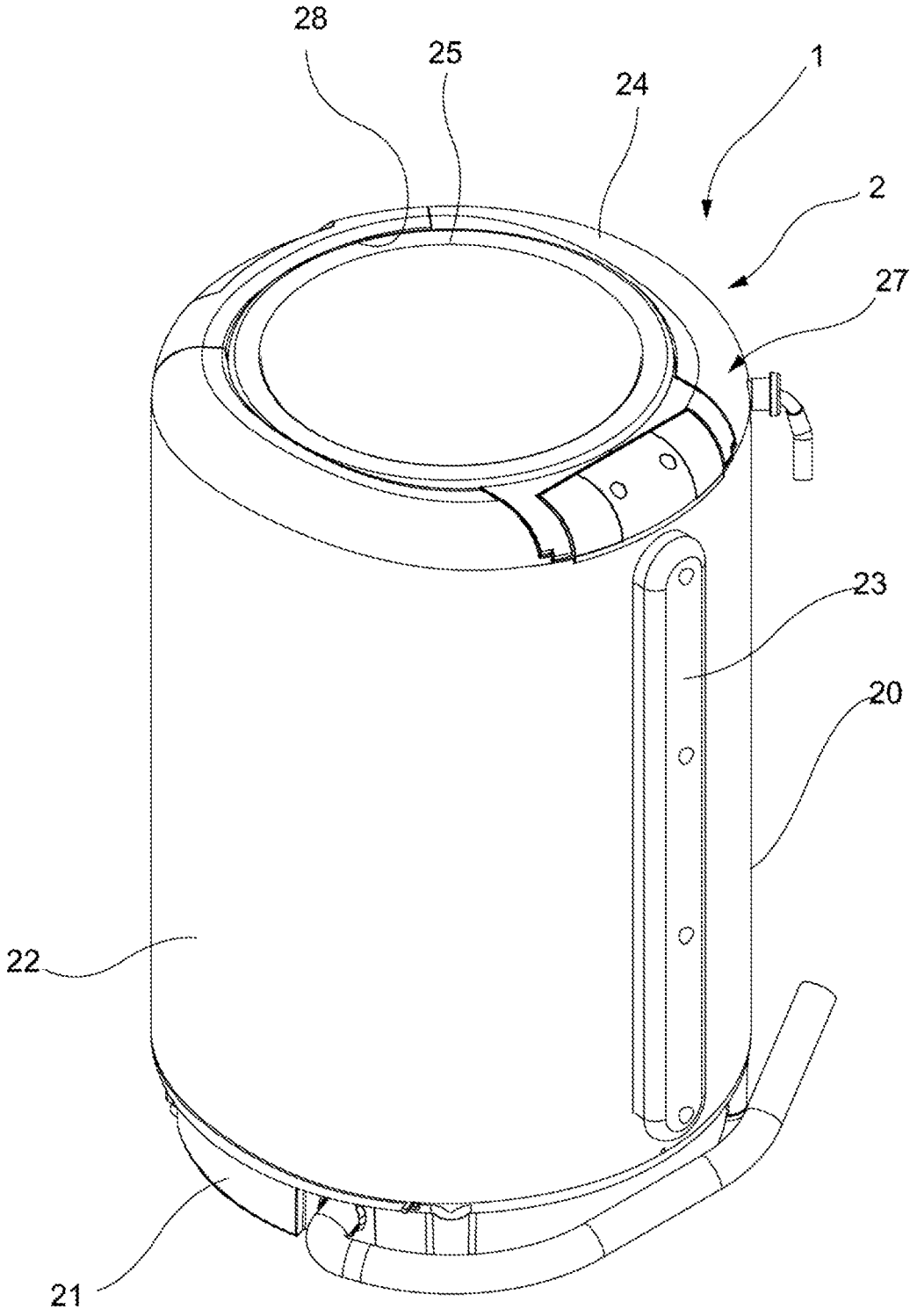
FIG. 1 is a three-dimensional diagram illustrating an appearance of a washing machine in an embodiment of the present disclosure.
Figure 2:
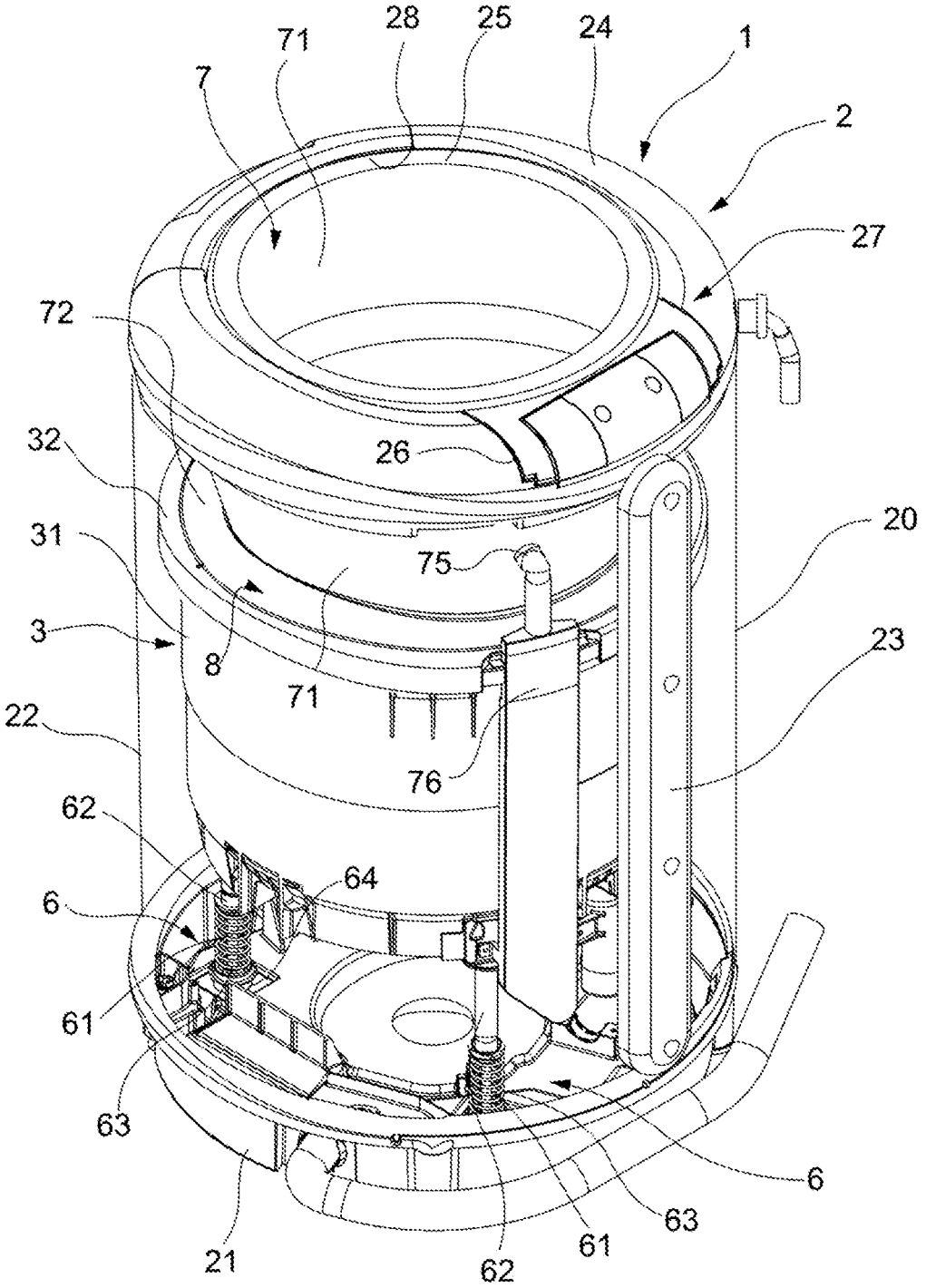
FIG. 2 is another three-dimensional diagram illustrating the same embodiment.
Figure 3:
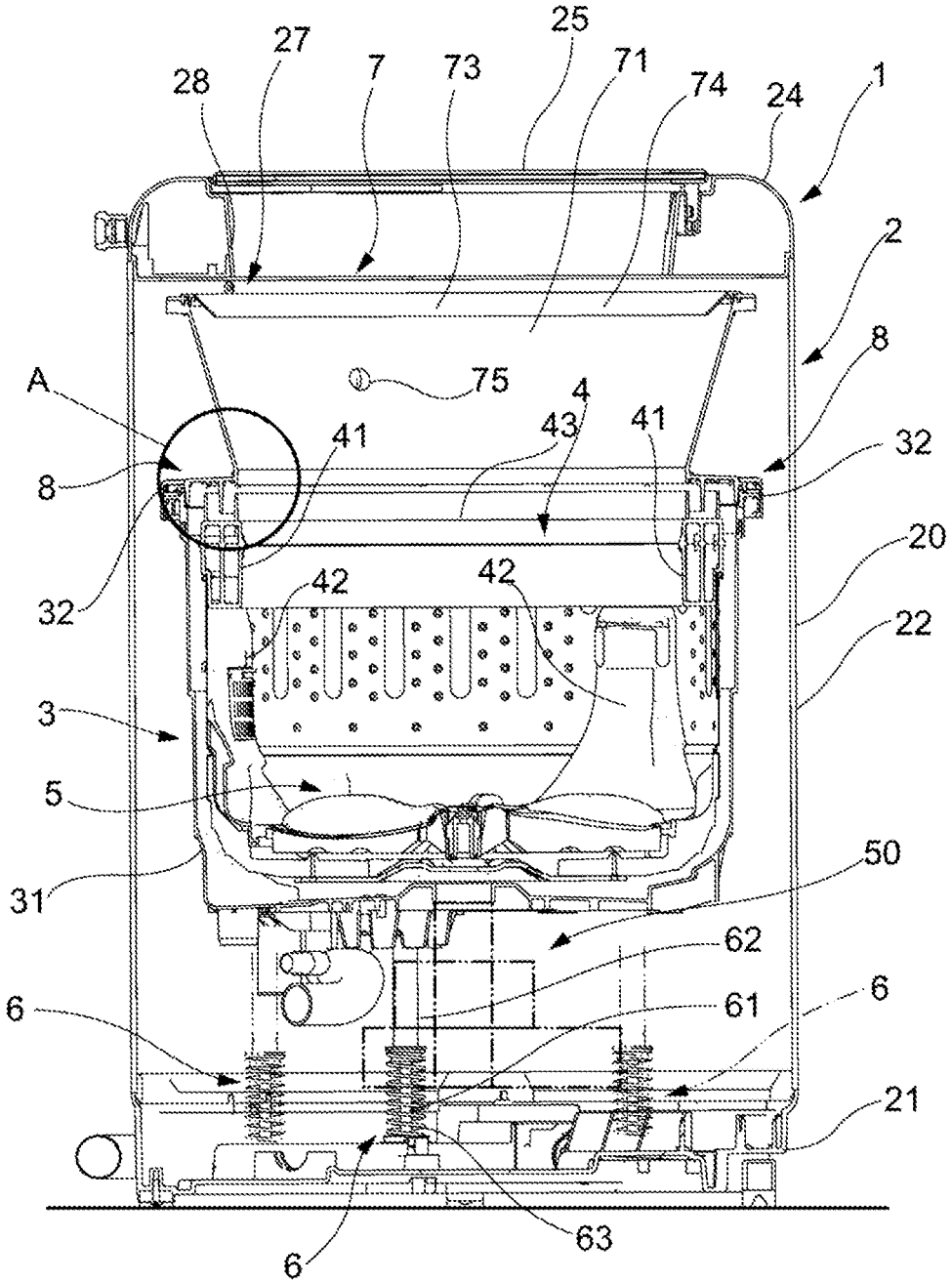
FIG. 3 is a side sectional view illustrating the same embodiment.

FIG. 1 is a three-dimensional diagram illustrating an appearance of a washing machine 1 in the present embodiment. FIG. 2 is an external view illustrating a state seen in a washing machine 1 of the present embodiment. In addition, FIG. 3 is a sectional view illustrating a main internal structure of a same washing machine 1. A driving unit, control-related units and figures of the control-related units of the washing machine 1 are omitted properly in the same figure.

The washing machine 1 in the present embodiment is a washing machine suitable for use in, for example, families, and includes: a drum 4 for accommodating washings; a tub 3 for accommodating the drum 4; and a housing 2 for accommodating the drum 4 and the tub 3 in such a manner that the drum 4 and the tub 3 can be well seen from outside. In addition, in the present embodiment, besides the tub 3, the drum 4 and the housing 2 mentioned above, the washing machine further includes: a hopper 7 installed at an upper part of the tub 3; a vibration damper 6 installed at a lower side of the tub 3; and a labyrinth-type sealing part 8 arranged between the upper end of the tub 3 and a basal end of the hopper 7.

Herein, the washing machine 1 in the present embodiment includes: an drum 4 for accommodating washings; a tub 3 for accommodating the drum 4; a housing 2 having a housing body 20 configured to accommodate the tub 3 and using a cylindrical body 22 with an upper end being open as a main body, a fixed lid 24 fixed to the housing body 20, i.e., the upper end of the cylindrical body 22, and a movable lid 25 movably arranged on the fixed lid 24 enables the upper end of the housing body 20 to be selectively opened outwards and forming a lid side opening 28 with an drum side opening 43 formed in the upper end part of the drum 4 open upwards; and a water supply part 27 arranged on the fixed lid 24 and is configured to supply water to the drum 4, an inner circumference of the lid side opening 28 has a shape obtained by opening the drum side opening 43 approximately upwards integrally.

Structures of composition elements which form the washing machine 1 are illustrated below.

The housing 2, as shown in FIG. 1 and FIG. 2, has an approximately cylindrical shape, and is separated from the tub 3 accommodated inside by an approximately uniform dimension when observed from top. The housing 2 includes: a housing body 20 configured to accommodate the tub 3, having a bottom wall 21 supporting the tub 3 from the lower side, and setting a cylindrical body 22 which is open at an upper end as a main body; a fixed lid 24 fixed to the upper end of the cylindrical body 22 and is formed with a circular annular shape when observed from top; and a movable lid 25 has an approximately circular shape when observed from top, movably arranged on the fixed lid 24 with the upper end of the housing body 20 selectively open outwards and forming a lid side opening 28 with an drum side opening 43 formed in the upper end part of the drum 4 open upwards. The housing body 20 includes: a cylindrical body 22 has a cylindrical shape and is formed by, for example, transparent or semitransparent resin of acrylic acid and the like; a wire cover 23 arranged across the top and bottom of the cylindrical body 22 and is configured to accommodate various wires; and a bottom wall 21 indirectly supporting the outer tub 3 from the lower side at a bottom s side of the housing body 20. The fixed lid 24 has a lid side opening 28 with an approximately circular-shaped opening in an inner circumferential side, and has a hinging part 26 supporting the movable lid 25 movably in a manner of opening and closing. Moreover, a water supply part 27 is provided. The water supply part is disposed in a position for displacing from the hinging part 26 to a circumferential direction and is configured to supply water to the drum 4.

The tub 3 is a bottomed cylindrical component arranged in the housing 2, and washing water may be stored inside. The tub 3 includes: a tub body 31 for storing water; a tub cover 32 arranged on an upper end of the tub body 31; and a packing water-sealing part 34 clamped between the tub body 31 and the tub cover 32 to prevent water from leaking outside. The packing water-sealing part 34 includes a water-sealing component 36 arranged at a lower side of the tub cover 32 and a packing component 35 configured to prevent the water from leaking. In addition, nearby specific structures about the packing water-sealing part 34 are described later.

The drum is a bottomed cylindrical component configured coaxially with the tub 3 in the tub 3 and is supported rotatably. The drum 4 is an ordinary component accommodating laundry inside and having a plurality of water through holes in a wall surface. As shown in FIG. 3, a balancer 41 protruding inwards to form a circular annular shape and three lifters 42 protruding inwards on a lower side of the balancer 41 are arranged on an upper end side of an inner circumferential surface of the drum 4.

A pulsator (agitating wing) 5 driven by a driving device 50 shown by an imaginary line is rotatably arranged in the center of a bottom of the drum 4 in the washing machine 1. The pulsator 5 is an ordinary component having an approximately disk-shaped pulsator body and a plurality of blade parts formed on an upper surface of the pulsator body. The pulsator 5 agitates the washing water stored in the tub 3 to produce a water flow. Although the position of the driving device 50 is shown only by the imaginary line in the same figure, a motor not shown is regarded as a main body so that a driving shaft extending to a bottom of the drum 4 rotates to rotate the drum 4 and the pulsator 5. The washing machine 1 mainly rotates the pulsator 5 in a washing process and rotates the drum 4 and the pulsator 5 integrally at high speed in a dewatering process.

In addition, in the present embodiment, the tub 3 and the drum 4 in the housing 2 are supported on the bottom wall 21 of the housing 2 by means of the damper 6 from the lower side. In addition, the tub 3 is not supported by a hoisting rod from a lateral surface or an upper side. That is, the configuration of the hoisting rod is avoided in the washing machine 1 in the present embodiment, thereby further increasing visibility of the laundry to be observed from the upper side, which will be detailed below.

The damper 6 is a component supporting the operating tub 3 from a lower side and configured to effectively reduce vibration generated by the operating tub 3. The damper 6 includes: an inner shaft 61 fixed to the bottom wall 21 of the housing 2; an outer shaft 62 covering an outer side of the inner shaft 61 and fixed to the tub 3 side; and a spring 63 is a compression coil spring used to reduce the vibration transferred to the housing 2 by being sandwiched between a lower end of the outer shaft 62 and the bottom wall 21 side of the housing 2 and properly extended and contracted in response to the up and down movement or vibration of the tub 3. In addition, a buffer rubber 64 is arranged between the outer shaft 62 and the tub 3 and between the inner shaft 61 and the bottom wall 21. In the present embodiment, the damper 6, as shown in FIG. 2 and FIG. 3, is provided in a position with a largest diameter or near the position within a range without protrusion when observed from top from the bottom of the outer tub 3. In addition, in the present embodiment, an elastic constant of the spring 63 is reduced in such a degree that the spring is not excessively compressed during dewatering and such a degree that the tub 3 is not inclined during operation. In addition, in the present embodiment, as described above, the hopper 7 is arranged in such a manner of being clamped from an upper side of the outer tub 3, i.e., specifically from the lid side opening 28 of the fixed lid 24, to the drum side opening 43.

The hopper 7, as shown in FIG. 2 and FIG. 3, is arranged between the lid side opening 28 and the drum side opening 43, performs a function as a water receiving guidance component for guiding throwing-in and taking-out of the laundry from the lid side opening 28 to the drum side opening 43, and is provided to guide throwing-in and taking-out of the laundry from the lid side opening 28 to the drum side opening 43. The hopper 7 is formed by an integrally formed product constituted to be transparent or semitransparent resinous, and has a hopper body 71 with an approximately conical shape, i.e., conical shape, and a protrusion part 72 extending from a lower end of the hopper body 71 to an outer side. A diameter of an opening part as an inner edge of the protrusion part 72 is formed into a diameter approximately matching with the drum side opening 43. In addition, the hopper body 71 includes: a large-diameter upper end part 73 with an upper end opening larger than the drum side opening 43; a retracing end 74 arranged on the large-diameter upper end part 73; and an overflow hole 75 which is a hole formed in any position of a middle position in an up-down direction of the hopper body 71 for setting upper limit water levels of the washing process and the rinsing process. The material of the hopper 7 is a resin material, a material with a specific gravity smaller than the material used in the tub 3 is also adopted sometimes, and the hopper 7 is a light structure comparing with the tub 3.

Figure 4:
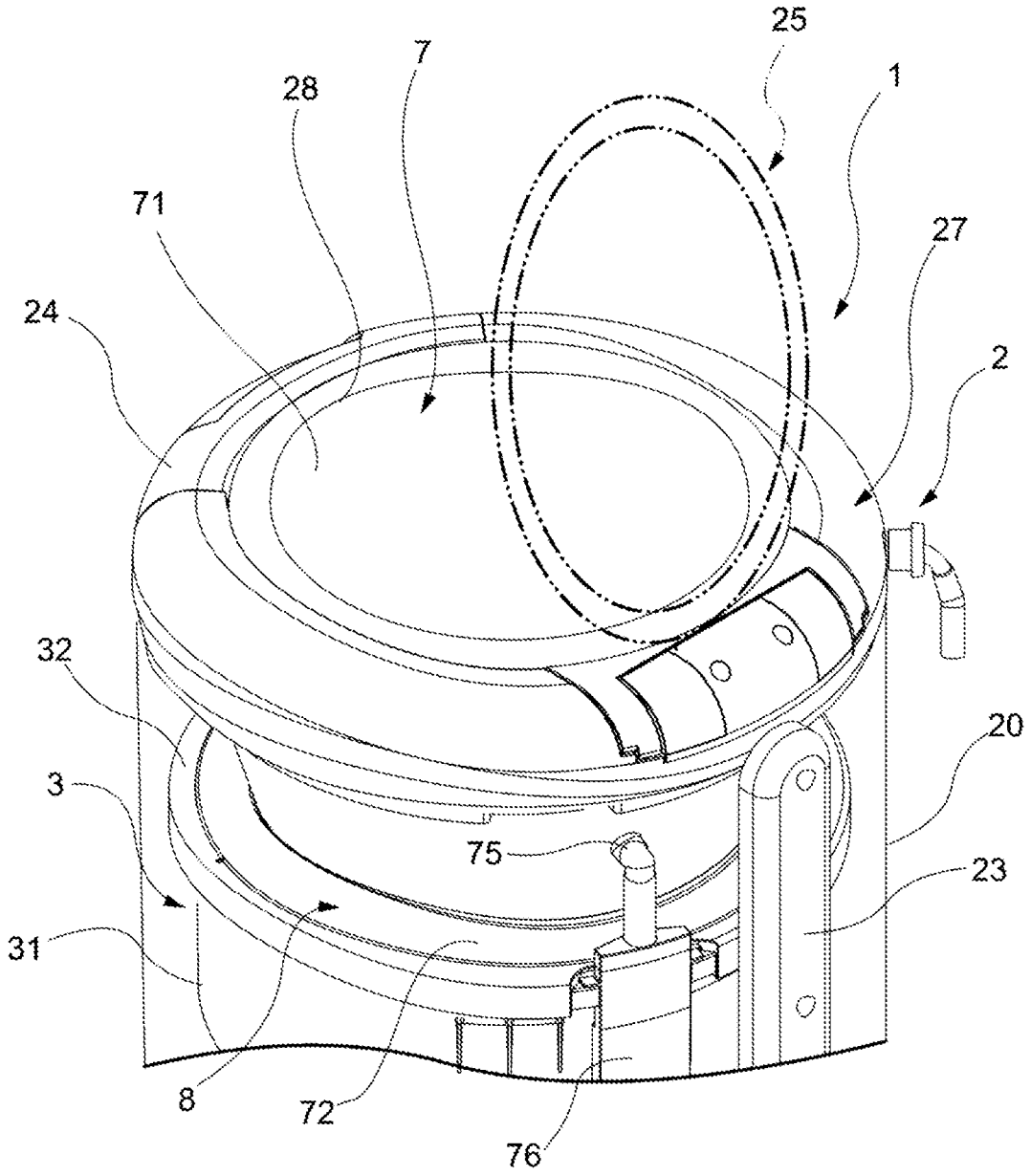
FIG. 4 and FIG. 5 are diagrams illustrating functions of the same embodiment.

Moreover, at the outer side of the overflow hole 75, as shown in FIG. 2 and FIG. 4, an overflow pipe 76 is connected. The overflow pipe is provided to drain water from the overflow hole 75 to the outer side of the washing machine in a manner of preventing the water from being accumulated at the upper side of the overflow hole 75. The overflow pipe 76 uses a part which has a bent oval shape when observed from a top view as a main body in order to effectively use a circumferential space between the housing 2 bent into a cylindrical shape and the tub 3. Moreover, since a mechanism and a structure for draining off the water from the overflow pipe 76 to the outer side of the washing machine are an existing mechanism and structure, a detailed description is omitted.

In addition, in the present embodiment, especially as shown in FIG. 4, the inner circumference of the lid side opening 28 of the fixed lid 24 is configured as a shape of integrally opening the drum side opening 43 approximately upwards, and the drum side opening 43 arranged in the upper end of the drum 4 is approximately integrally set as a shape of upward opening. In other words, an open edge of the lid side opening 28 is arranged on the outer side of any position of the open edge of the drum side opening 43.

The hopper 7 performs a function as a heightened drum for storing extra water when the water level is higher than the upper end of the drum 4. Namely, the hopper 7 has a function of serving as a washing drum. In addition, in the present embodiment, as described above, since the cylindrical body 22, the movable lid 25 and the hopper 7 of the housing body 20 are provided to be transparent or semitransparent, it is easy to see laundry which rise near a water surface of the hopper 7 by means of the fixed lid 24 during washing, and from the side surface, it is also easy to see laundry near the water surface from the side surface by means of the cylindrical body 22 and the hopper 7. In other words, the visualization of the laundry is optimized. Moreover, by providing the cylindrical body 22 to be transparent or semitransparent, visualization of internal mechanism components is also increased. Therefore, the grasping of the operating state by a user and the convenience for operations are improved.

In addition, although the hopper 7 performs a function as the heightened drum during washing in the present embodiment, the hopper 7 is provided with an approximately conical shape, i.e., a conical shape, so as to guide the laundry to the drum 4 as a dewatering drum during dewatering, thereby reliably storing the laundry into the drum 4.

Figure 5:
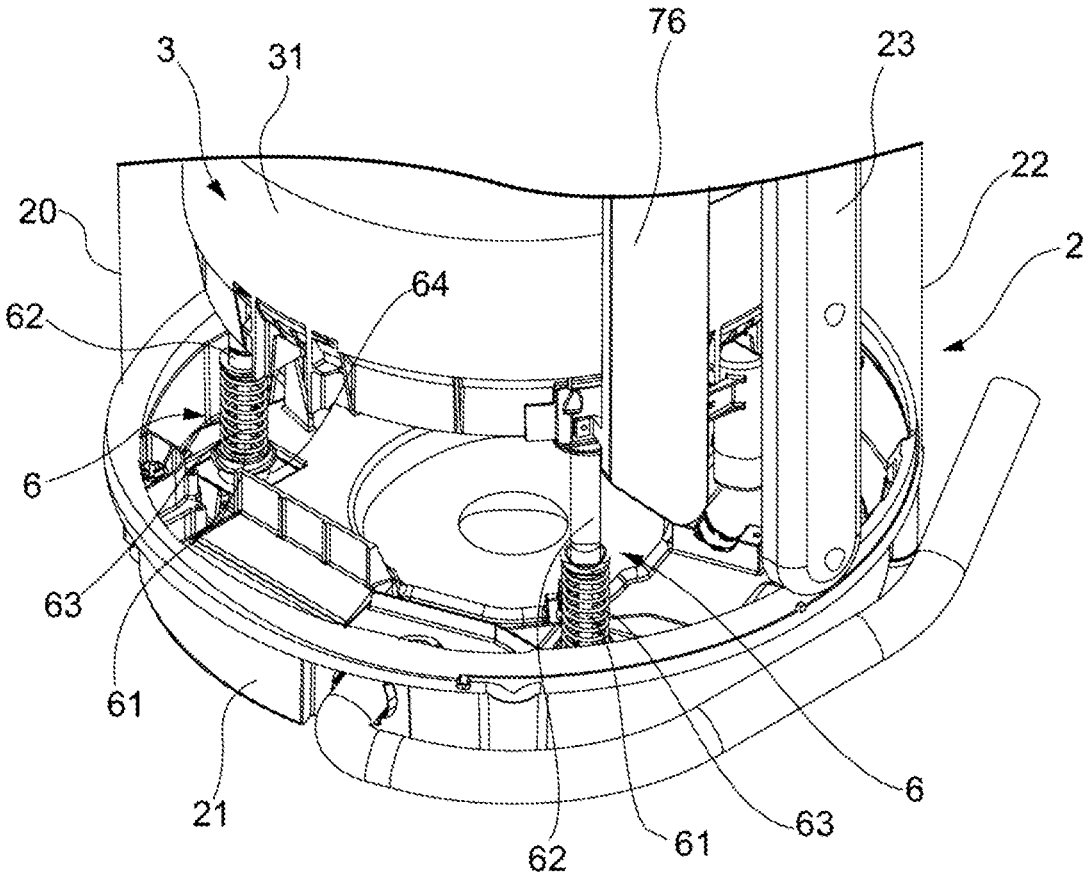

In addition, in the present embodiment, especially as shown in FIG. 5, the damper 6 is configured at the lower part of the tub 3 and the hopper 7 as the heightened drum is formed with a light-weight type, thereby increasing natural vibration frequency of the part supported by the damper 6 and vibration is further reduced during dewatering.

Further, in the present embodiment, although the hopper 7 is fixed to the tub 3 and cannot be rotated, in another aspect the drum 4 is certainly formed to be rotatable, a leaking may not occur between the drum 4 and the hopper 7.

Figure 6:
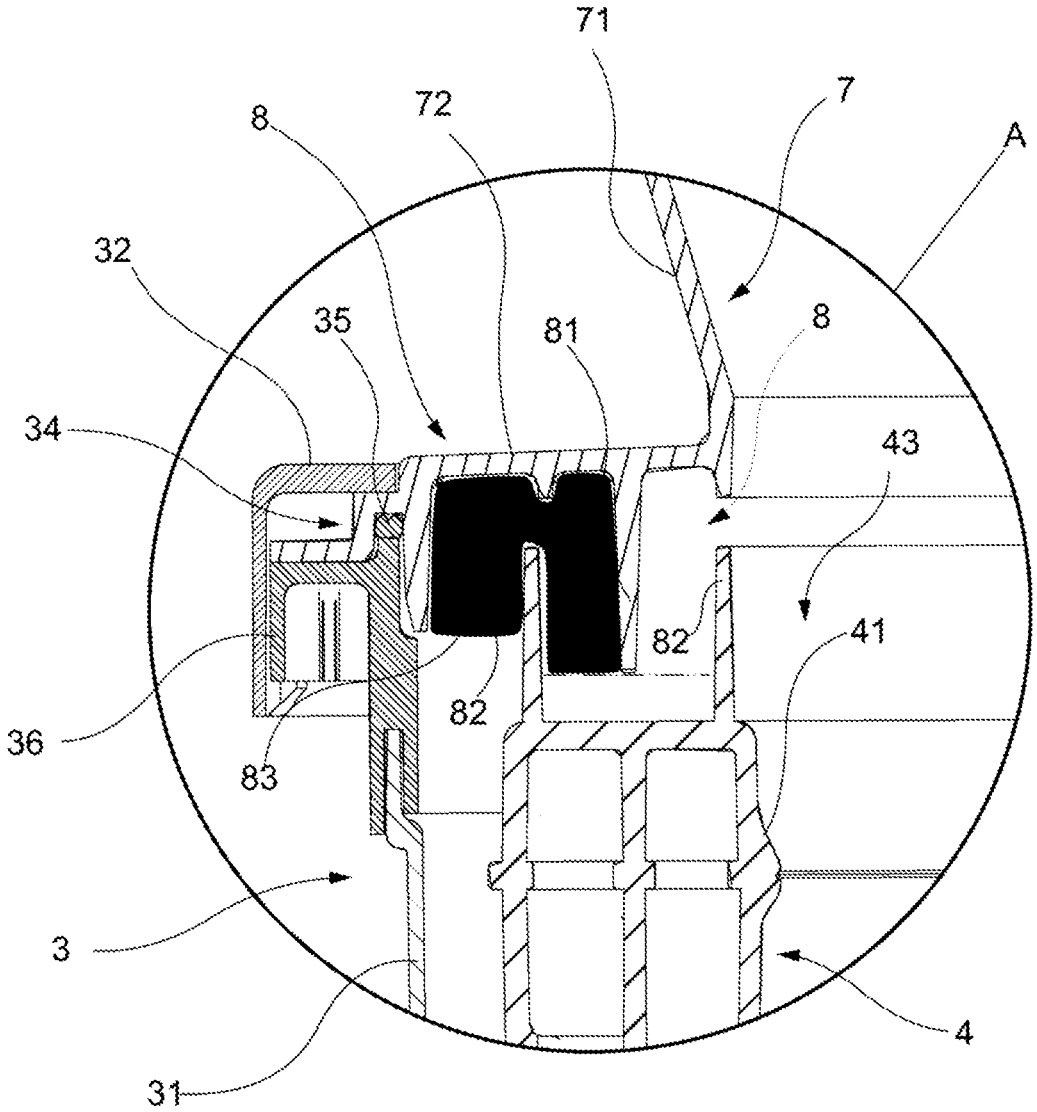
FIG. 6 is an enlarged view illustrating part A in FIG. 3.

That is, in the present embodiment, especially as shown in FIG. 6, the labyrinth-type sealing part 8 is a component formed across regions of the hopper 7, the tub 3 and the upper end of the drum 4, and includes: an upper side rib 81 arranged on the protrusion part 72 of the hopper 7 and extending to the lower side in a vertical direction; a lower side rib 82 arranged on the upper end of the drum 4 and extending to the upper side in the vertical direction; and an air accumulation part 83. The packing component 35 is located on the upper end of the outer tub 3, and is arranged in a position including the upper side of the vertical direction of an imaginary plane of the front end part of the upper side rib 81 to seal the upper end of the tub 3 and the protrusion part 73. Thus, the air of the air accumulation part 83 can be prevented from exceeding the packing component 35 and leaking outside the tub 3.

When the water is accumulated on the upper side of the balancer 41 of the drum 4, a water level in the labyrinth-type sealing part 8 is formed to be approximately in a same plane as the front end part of the upper side rib 81, and the air accumulation part 83 is formed between the water level and the inner circumferential surface of the protrusion part 72 above the water level. By forming the air accumulation part 83, even if the water in the hopper 7 moves from a place between the upper and the lower ribs 81 and 82 to the outer side, the water moving to the outer side may be strongly inhibited by the air accumulation part 83 since the air accumulation part is already formed near the packing component 35. In addition, since the packing component 35 is arranged, even if the water exceeds the air accumulation part 83 and immerges, the water can be prevented from flowing to the outer side of the tub 3. Thus, the quantity of fasteners required for connecting the tub 3 with the hopper 7 may be effectively reduced.

As mentioned above, by providing an inner circumference of the lid side opening 28 as a shape of opening the drum side opening 43 approximately upwards integrally in the washing machine 1 of the present embodiment, the fixed lid 24 as the upper surface plate is contracted and the movable lid 25 performing a function as the upper cover is increased, so that the washing machine is formed in such a manner that a throwing-in and taking-out route of laundry is not narrowed, and operations of throwing-in and taking-out may be performed smoothly. In addition, according to the present embodiment, the water supply part 27 is arranged in a non-blocking position, thereby avoiding a structure of supplying water from the upper surface of the upper cover as the upper surface plate. As a result, when the washing machine is observed from top, since the cylindrical drum 4 is integrally in a visual state, it is easy to see a washing condition.

In addition, in the present embodiment, since the opening edge of the lid side opening 28 is disposed at the outer side of any position of the opening edge of the drum side opening 43, the whole drum 4 can be upwards opened reliably. In addition, in the present embodiment, the appearance of the housing 2, the tub 3 and the drum 4 formed as a concentric circle shape, and the movable lid 25 is set as a disk shape. Thus, as long as the fixed lid 24 as the upper surface plate is circular annular or the side wall of the housing 2 is cylindrical, a distance to the drum 4 may not be changed regardless of the position of arranging the water supply part 27 in the circumferential direction. In addition, a throwing-in and taking-out direction of the laundry is also not limited to a specific orientation opposite to the hinging part 26; and it is easy to perform the throwing-in and taking-out of the laundry even if in an inclined direction from the hinging part 26.

In addition, according to the present embodiment, the water supply part 27 is arranged in the position of displacing from the hinging part 26 to the circumferential direction, so that the hinging part 26 is arranged along a wall. The water supply part 27 is equivalent to be arranged at the position of a corner part of an existing rectangular housing, so that no hindrance exists even if a same configuration as before is adopted.

In addition, according to the present embodiment, the hopper 7 as a water receiving guidance component arranged between the lid side opening 28 and the drum side opening 43 and configured to guide throwing-in and taking-out of the laundry from the lid side opening 28 to the drum side opening 43 is provided as an approximately conical shape having an upper end part with an opening larger than the drum side opening 43 and a lower end with a size approximately matching with the drum side opening 43. Thus, even if the water supply part 27 is arranged in the above position, water can be injected and throwing-in or taking-out of the laundry can be performed more smoothly. In addition, the visibility of the drum 4 may not be reduced when the washing machine is observed from top.

Although an embodiment of the present disclosure is described above, the structure of the present embodiment is not limited to the above-mentioned embodiment and can be varied in any form.

For example, although above embodiments disclose that the drum side opening and the lid side opening are circular structures, a polygon can be, for example, applied as the shape of one or both of the drum side opening and the lid side opening as long as the drum side opening is open upwards.

In addition, although above embodiments disclose a structure that the water receiving guidance component is installed at the drum side, certainly, such a structure can also be configured that the water receiving guidance component is installed at the housing side, i.e., the fixed lid or the housing body side.

Various variations can be made to other structures without departing from the scope of the spirit of the present disclosure.

A LIST OF REFERENCE NUMERALS

1: washing machine; 2: housing; 4: drum; 8: labyrinth-type sealing part; 20: housing body; 24: fixed lid; 25: movable lid; 27: water supply part; 28: lid side opening; 43: drum side opening; 81: rib (upper rib); and 82: rib (lower rib).

What is claimed is:

1. A washing machine, comprising: a drum for accommodating laundry and formed with a drum opening; a tub for accommodating the drum; and a housing for accommodating the drum and the tub, wherein the housing comprises:

a cylindrical body having an upper end being open;

a bottom wall arranged on a lower end of the cylindrical body and configured to support the tub from a lower side;

a fixed lid fixed to the upper end of the cylindrical body and formed with a lid opening; and a movable lid disposed on the fixed lid and configured to block the lid opening;

wherein the washing machine has a water supply part arranged on a side wall of the housing or the fixed lid and configured to supply water to the drum; and wherein an inner circumference of the lid opening has a shape obtained by opening the drum opening approximately upwards integrally; and wherein the washing machine further comprises a water receiving guidance component arranged between the lid opening and the drum opening and configured to guide throwing-in and taking-out of laundry from the lid opening to the drum opening; and wherein the water receiving guidance component has an approximately conical shape, and wherein the conical shape has an upper end with an opening larger than the drum side opening and a lower end with a size approximately matching with the drum side opening.

2. The washing machine according to claim 1, wherein an opening edge of the lid opening is disposed at an outer side of any position of an opening edge of the drum opening.

3. The washing machine according to claim 1, wherein a profile of the housing, the tub and the drum are formed as a concentric circle shape, and the movable lid is configured as a disk shape.

4. The washing machine according to claim 1, wherein the housing comprises a hinging part for movably supporting the movable lid relative to the fixed lid, and the water supply part is disposed at a position for displacing from the hinging part along a circumferential direction.

5. The washing machine according to claim 2, wherein a profile of the housing, the tub and the drum are formed as a concentric circle shape, and the movable lid is configured as a disk shape.

6. The washing machine according to claim 2, wherein the housing comprises a hinging part for movably supporting the movable lid relative to the fixed lid, and the water supply part is disposed at a position for displacing from the hinging part along a circumferential direction.

* * * * *